US007556558B2

(12) United States Patent
Palmgren

(10) Patent No.: US 7,556,558 B2
(45) Date of Patent: Jul. 7, 2009

(54) SHAPE CONTROLLED ABRASIVE ARTICLE AND METHOD

(75) Inventor: Gary M. Palmgren, Lake Elmo, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/236,461

(22) Filed: Sep. 27, 2005

(65) Prior Publication Data

US 2007/0072527 A1 Mar. 29, 2007

(51) Int. Cl.
*B23F 21/03* (2006.01)

(52) U.S. Cl. ..... 451/540; 451/541; 451/548; 451/559

(58) Field of Classification Search ..... 451/540, 451/541, 548, 552, 526, 559; 51/295, 293, 51/307

See application file for complete search history.

(56) References Cited

U.S. PATENT DOCUMENTS

| | | | | |
|---|---|---|---|---|
| 3,464,550 | A | 9/1969 | Bieler et al. | |
| 3,672,500 | A | 6/1972 | Hayes | |
| 4,261,706 | A * | 4/1981 | Blanding et al. | 51/295 |
| 6,123,612 | A | 9/2000 | Goers | |
| 6,368,198 | B1 * | 4/2002 | Sung et al. | 451/443 |
| 2006/0032836 | A1 * | 2/2006 | Feng et al. | 216/88 |

FOREIGN PATENT DOCUMENTS

| | | |
|---|---|---|
| WO | 87/07187 | 12/1987 |

* cited by examiner

*Primary Examiner*—Eileen P. Morgan
(74) *Attorney, Agent, or Firm*—Dean M. Harts; James A. Baker

(57) ABSTRACT

Provided are an abrasive tool comprising abrasive particles having an average shape controlled to within a small range, and methods of providing such tools. Thus, a large number of abrasive tools will have very similar operating characteristics, and abrasive tools made at different times or through different methods also can have very similar operating characteristics.

19 Claims, No Drawings

SHAPE CONTROLLED ABRASIVE ARTICLE AND METHOD

TECHNICAL FIELD

This invention relates to abrasive tools including abrasive particles where the particles have a controlled shape, as well as methods of making such tools.

BACKGROUND

There are a variety of abrasive particles (e.g., diamond particles, cubic boron nitride particles, fused abrasive particles (including fused alumina, heat treated fused alumina, fused alumina zirconia, and the like), and sintered, ceramic abrasive particles (including sol-gel-derived abrasive particles)) known in the art. Features such as hardness, friability, crush strength, sharpness, size, and other characteristics of the abrasive particles used can have an influence on the abrasive performance of a particular abrasive article in particular abrading applications. In some abrading applications, the abrasive particles are incorporated into abrasive products (including bonded abrasives, coated abrasives, and nonwoven abrasives).

Many different types of abrasive articles are available. These include: (1) coated abrasive articles, in which a binder make coat bonds the abrasive particles to a backing material; (2) lapping coated abrasive articles, in which the abrasive particles are dispersed in a binder to form an abrasive composite, which is bonded to a backing to form an abrasive article; (3) three-dimensional shaped composite abrasive articles, in which the abrasive particles typically are dispersed in a binder to form a plurality of abrasive composites, which are bonded to a backing to form an abrasive article; (4) bonded abrasive articles, in which the binder bonds the particles together to form a shaped mass, e.g., a grinding wheel or brush; and (5) nonwoven abrasive articles, in which the binder bonds the abrasive particles onto the fibers of a nonwoven fibrous substrate in either a make coat or dispersed format.

SUMMARY

As abrasive articles are increasingly becoming useful in precision, automated finishing applications, which preferably employ standard conditions of time and applied pressure to achieve desired stock removal and/or surface finish levels, the present inventor has noted that it becomes increasingly desirable to have available abrasive articles which are uniform in their abrading performance. Efforts to control abrasive performance among multiple abrasive tools through the selection of a limited size range of particles used in the tool construction generally result in abrasive particles which may be used to produce groups or lots of abrasive articles capable of achieving similar surface finishes or similar cut rates under fixed conditions. Yet there remains an undesirable degree of variability in the performance of any individual tool compared with another individual tool, and a correspondingly greater variability within a batch of abrasive tools. Such unpredictable behavior necessitates undesirable monitoring of the abrasive process and frequent characterization of the performance of each abrasive tool.

In certain applications the abrasive article cut rate is important to the user. Abrasive articles with a cut rate too high or too low cannot be used in these precision processes. Rather, only those articles within a specified range of cut rate are useful. The present inventor has found that any particular production run of abrasive articles may have a poor yield of acceptable products when the shape of the abrasive particles mineral is not controlled using the present invention.

It has been found that significant improvement in uniformity of the abrasive performance of an abrasive process can be achieved by tightly controlling the shape of the abrasive particles incorporated into abrasive tools used in that process. This is in addition to the commonly controlled size and composition of the particles used to fabricate the tools or abrasive articles. With this invention, it becomes possible to fabricate a number of tools having very similar abrasive performance under standardized conditions and to maintain that uniformity across multiple lots of input abrasive particles. The inventive method employs a measure of particle shape to characterize the particles to be used in the fabrication of an abrasive article.

Briefly, the present invention provides an abrasive tool comprising abrasive particles having an average shape controlled to within about 1% of a target value.

In another aspect, the present invention provides a method of controlling abrasive particle shape comprising providing a first quantity of abrasive particles and measuring a first Shape Parameter, providing a second quantity of abrasive particles and measuring a second Shape Parameter; determining a target Shape Parameter between the first Shape Parameter and the second Shape Parameter; combining an amount of particles of the first Shape Parameter with an amount of particles of the second first Shape Parameter such that the weighted average combination yields the target Shape Parameter.

In another embodiment, the invention provides a method of producing a plurality of abrasive tools, each of which comprises a plurality of abrasive particles wherein each plurality of particles has a mean Shape Parameter within about 1% of a target value, comprising providing abrasive particles, sorting the abrasive particles by shape into a plurality of subpopulations, selecting an amount of abrasive particles from at least two subpopulations and combining these amounts into a plurality of abrasive particles, such that the resulting plurality of abrasive particles has the desired Shape Parameter, fabricating the abrasive tools from the plurality of abrasive particles having the desired Shape Parameter.

It is an advantage of the present invention to provide abrasive tools using shape-controlled abrasive particles. Such tools can provide highly repeatable abrasive performance from tool to tool and lot to lot, even in precision applications. It is another advantage of the present invention to provide abrasive tools suitable for use in automated processes where conditions can be set and maintained for a given quantity or lot of abrasive tools.

Other features and advantages of the invention will be apparent from the following detailed description of the invention and the claims. The above summary of principles of the disclosure is not intended to describe each illustrated embodiment or every implementation of the present disclosure. The following detailed description more particularly shows certain presently preferred embodiments using the principles disclosed herein.

DETAILED DESCRIPTION OF PRESENTLY PREFERRED EMBODIMENTS

All numbers are herein assumed to be modified by the term "about". The use of numerical ranges by endpoints includes all numbers subsumed within that range (e.g., 0.1 to 5 includes 0.1, 0.13, 0.97, 1, 1.5, 2.75, 3, 3.80, 4.01, and 5).

An increasing number of precision abrasive processing applications are being performed under machine or computer control rather than by human operators. These processes rely upon application of the abrasive to the workpiece under predetermined conditions such as time and pressure with the expectation that the abrasive performance will be very similar from tool to tool. Abrasive articles should be as consistent in their abrasive performance as possible for this approach to be truly successful. However, when measured against these continually increasing standards, the commonly employed abrasive particles vary significantly from lot to lot, and thus subsequently from tool to tool. Manufacturers of the abrasive particles try to sort and supply their particles by size ranges, and even by various characteristics of the particles such as monocrystalline or polycrystalline. However, the present inventor has found that the shapes of the commercially available particles remain uncontrolled and thus shape varies. Because of this variability, some lots of abrasive particles have a greater fraction of particles that are rounded and somewhat blunt while other lots are excessively jagged and sharp. Then, tools manufactured from abrasive particle lots that are described and sold as the same typically have significantly different abrading characteristics, such as removal rate and surface finish, in precision applications. Others have recognized the importance of shape in determining abrasive performance, however very little has been done to control the shape of the individual abrasive grains in a reproducible manner. Some manufacturers have elected to use production methods that result in a preponderance of particles having a similar shape such as the generally spherical alpha-alumina which results from a chemical vapor deposition (CVD) process.

The present invention provides abrasive tools that include abrasive particles having a controlled average shape. In some embodiments, the shape is controlled to within about 1% of a target value. In another embodiment, the shape is controlled to within about 0.5%, 0.3%, 0.2%, of a target value, or controlled even more precisely. The invention is particularly useful with irregular abrasive particles. Such particles typically are crushed from larger input materials and sorted by size using known methods. Particle sizing via screening removes undesirably large particles and allows particles of varying shapes to pass through the screen depending upon particle orientation. For example, a long narrow particle may be held up on a screen or may pass through the same screen depending on orientation. Typical operations require vibration, which changes particle orientation and speeds up sizing. Thus, known abrasive particles may be supplied according to size, but this size varies and the shape of the particles typically is not controlled.

With the present invention, shape can be controlled using a vibratory shape sorting table along with particle analysis and selection. Such vibratory shape sorting tables are known, however they were used to remove extremes of the shape distribution within a lot of abrasive particles. These vibratory tables generally can be used to separate odd-shaped particles from a lot of abrasive grains of the same size range (e.g., ranging from nearly ideal crystals or cubooctahedral shapes to broken particles having irregular shapes or high aspect ratio needle-like particles or platelets) using an inclined vibrating tray. Other useful shape sorting devices are found, for example, in U.S. Pat. Nos. 3,672,500 and 3,464,550 and WO 87/07187. In the invention, these devices are used to separate a lot of abrasive particles having different shapes into fractions. One source of a useful inclined oscillating table is Vollstaedt Diamant GmbH, Berlin, Germany.

The shape of abrasive particles or abrasive mineral can be measured by optical microscopy and image analysis, preferably aided by computer, resulting in a Shape Parameter. The Shape Parameter can be, for example, a Roundness Index, sphericity, or aspect ratio. For example, two-dimensional silhouettes of a representative sample of a quantity of abrasive particles can be used with image analysis to characterize that quantity of abrasive particles according to shape. One measure of the particle shape is the Roundness Index. This is the ratio of the perimeter of a silhouette squared to four times pi times the area of the silhouette. The inverse of this ratio can be called the sphericity. Another measure of particle shape is the aspect ratio, which is generally known in the art of abrasive particles and refers to the ratio of length to width, or length to cross-section (e.g., diameter), or the largest cross-sectional dimension to the smallest cross-sectional dimension when increasingly irregular particles are at issue. In addition, image analysis can be used to fit an elliptical shape to the silhouette of a particle and then report the ratio of the major axis to the minor axis of the fitted elliptical shape as the aspect ratio.

Measuring and controlling the Shape Index allows one to control the shape of the abrasive mineral. Controlling the shape of selected particles also may control the sharpness, cut rate, or another useful abrasive parameter, allowing repeatable abrasive performance over a plurality of abrasive tools. The abrasive particles sharpness is one of the major factors influencing the cut rate of an abrasive article made with those abrasive particles.

The present inventor has found that selection of abrasive particles having a controlled mean shape from within abrasive particles sized by the supplier can improve the tool-to-tool consistency of abrasive tools produced from the selected particles. In some embodiments of the invention, the particles from a supplier's lot of abrasive particles are sorted into two or more sublots, also called subpopulations, based upon shape, for example by the use of a vibratory table. Then, individual sublots are characterized by image analysis to provide a mean shape index, e.g., Roundness Index or aspect ratio, for each sublot. The sublots are blended selectively using a mass weighted basis to provide abrasive particles having an average shape having a shape index having a target value. Then the abrasive particles having the desired shape index are used to fabricate one or more abrasive tools. Typically, the measured average shape may be controlled to within 1.0%, 0.5%, 0.3%, 0.2%, or in some embodiments more preferably within 0.1% of a target value. In some aspects of the current invention, shape controlled abrasive particles may be used to fabricate abrasive tools.

In other aspects of the present invention, the shape controlled particles can be distributed randomly throughout a binder, in an orderly fashion within a binder, or randomly within shaped, three-dimensional composites comprising the particles and a binder. In other aspects, or in combination with embodiments described above, the shape controlled particles can be formed into agglomerates for use in any known abrasive process or article, a few of which will be described later.

The invention also provides a method of controlling abrasive particle shape. Generally, a first quantity of abrasive particles is measured to determine a Shape Parameter, such as Roundness Index, sphericity, or aspect ratio. Also, at least one more quantity of abrasive particles also is measured to determine its Shape Parameter. Of course, many more lots can similarly be measured. A target Shape Parameter between the first Shape Parameter and the second Shape Parameter is selected. Or, when more than two lots of particles are to be used, the target Shape Parameter is selected to lie between the highest and lowest Shape Parameter among all the lots. Then, an amount of particles of the first Shape Parameter is combined with an amount of particles of the second Shape Parameter such that the weighted average combination yields the target Shape Parameter. Of course, multiple lots can be similarly combined such that the weighted average combination of all of the particle lots included yields the target Shape Parameter in the overall combination.

In another embodiment, the invention provides a method of producing a plurality of abrasive tools, each of which comprises a plurality of abrasive particles wherein each plurality of particles has a mean Shape Parameter within about 1% of a target value. One begins with abrasive particles which are then sorted by shape into a plurality of subpopulations, such as two, three, four, or a higher number, yet preferably below about 20, more preferably below about 17 or 16 subpopulations. Then, an amount of abrasive particles from at least two subpopulations is selected and combined into a plurality of abrasive particles using the weight average of each subpopulation, such that the resulting plurality of abrasive particles has the desired Shape Parameter. These particles are used to fabricate the abrasive tools including abrasive particles having the desired Shape Parameter.

More generally, the method of the present invention involves sorting abrasive particles into a number of sublots or subpopulations based upon shape, characterizing the shape of each sublot, and then blending portions of the sublots to obtain an abrasive particle population having a target average particle shape. This average shape target may be reproduced to within 1%, 0.5%, 0.3%, or even 0.2%, or even a closer range. It will be understood that the particles typically will have been selected for other properties and characteristics, such as size or density, and may undergo further selection based upon other characteristics. The sorted abrasive particles, having the desired mean shape, then can be used to fabricate tools or other abrasive articles having relatively reproducible abrasive performance. Any of a number of shape parameters may be used to characterize the abrasive particle lot or sublots, for example, roundness, sphericity, or aspect ratio. The shape parameter associated with the sublots may be determined by any of the methods commonly employed such as image analysis of a representative sample. It will be appreciated that the width of the final particle shape distribution as well as the mean shape parameter may also be controlled by the blending operation.

The invention provides abrasive tools with shape controlled particles, such that the tools from each individual lot or batch having closely similar particles as shown, by the Shape Parameters described herein, will have very similar abrasive operating performance, such as a more predictable cut rate and/or surface finish under fixed conditions.

The abrasive particles in the tool can be provided in a predetermined pattern, such as an orderly array. Such an array can be a matrix pattern or a pattern that may appear random or disordered for a particular tool, yet the same pattern used on a plurality of tools may not appear random or disordered.

The abrasive particles as described herein can be attached or secured to a substrate through any known method. For example, the particles can be brazed, infiltrated, electroplated, sintered, liquid-phase sintered, chemically bonded, metallurgically bonded, or adhesively bonded to the substrate, with particular selection within the knowledge of the skilled person in this field.

Abrasive tools of the present invention can be made, for example, by providing a multiplicity of abrasive particles, selecting a quantity of the abrasive particles having an average shape controlled to within about 1% of a target value, providing a substrate, and attaching selected abrasive particles to the substrate. After particles are sorted into a desired shape, an abrasive tool or many such tools can be made from these particles depending on the amount of particles and the number needed for any particular tool. In addition, known methods of placing abrasive particles into a template, sieve, or screen for placement into a relatively non-random array can be used. In such routes, more particles than finally required first may be applied, and then the excess particles removed before securing the remaining particles. Processes such as brazing, infiltrating, electroplating, sintering, liquid-phase sintering, chemically bonding, metallurgically bonding, and adhesively bonding can be used to attach or secure the abrasive particles into position.

The invention thus provides a method of controlling abrasive particle shape comprising, providing a first quantity (e.g., weight, number, or volume) of abrasive particles and measuring a first Shape Parameter indicative of the first quantity, providing a second quantity of abrasive particles and measuring a second Shape Parameter indicative of the second quantity. Then, determining a target Shape Parameter between the first Shape Parameter and the second Shape Parameter, and combining an amount of particles of the first Shape Parameter with an amount of particles of the second first Shape Parameter such that the weighted average combination yields the target Shape Parameter. Of course, one may also provide a third (and fourth, or even more) quantity of abrasive particles, and measure the Shape Parameter of the third and any further quantity of particles, then combine particles at each selected Shape Parameter with the other particles such that the weighted average combination yields the target Shape Parameter. As described above, the Shape Parameter can be selected from at least one of Roundness Index, aspect ratio, and sphericity.

The invention also provides a method of producing a plurality of abrasive tools, each of which comprises a plurality of abrasive particles wherein each plurality of particles has a mean Shape Parameter within about 1% of a target value. First, abrasive particles are provided. These typically are sold as a particular size. Then, the abrasive particles are sorted by shape into a plurality of subpopulations as described above. An amount of abrasive particles from at least two shape subpopulations are combined into a plurality of abrasive particles, such that the resulting plurality of abrasive particles has the desired Shape Parameter. Abrasive tools are then fabricated from the plurality of abrasive particles having the desired Shape Parameter. Any known method can be used to make the tools. Also, additional sublots or subpopulations (e.g., three to sixteen, 20 or even more) subpopulations can be combined so the resulting plurality of abrasive particles has the desired Shape Parameter. The amount of each sublot in the overall combination is determined so the overall weighted average results in the desired Shape Parameter. Most usefully, the invention uses close Shape Parameters for each sublot and fewer, if any, particles extremely different (i.e., varying by more than about 10%) from the target Shape Parameter.

This invention is useful in abrasive tools, especially tools useful in precision processes, automated processes, or where very similar tool-to-tool performance is desired. It is especially useful where the abrasive grit or particle size is between about 30 μm and about 1000 μm. Examples of tools include an abrasive cutting tool, saw blade, wire saw, CMP pad conditioner, dressing wheel, cutoff saw, polishing tool, and grinder. The invention is especially useful with high-value and superabrasive particles, such as diamond and cubic boron nitride.

Objects and advantages of this invention are further illustrated by the following examples, but the particular materials and amounts thereof recited in these examples, as well as other conditions and details, should not be construed to unduly limit this invention.

EXAMPLES

Materials

A shape sorting table was used to separate new lots of abrasive particles (diamond in this example) into 10 sequential bins containing progressively more irregular diamond particles. The average Roundness Index of each bin was measured using ImagePro software from Media Cybernetics L.P., Silver Spring, Md. Representative samples were taken from each bin, placed on a glass slide in an orderly array, and images were taken and analyzed to determine the average shape for the bin. and the mass of the diamond in each bin was weighed. It was found that the average shape of a combination of bins could be determined by computing the weighted average using the average shape of the diamond in each bin. For example, if the diamond in bin A had an average Roundness Index of 1.100 and had a mass of 1000 g, and the diamond in bin B had an average Roundness Index of 1.113 and a mass of 500 g, then the average roundness of the combination of bins A and B would be $(1.100\times1000+1.113\times500)/(1000+500)=1.104$. Lots of diamond having a specified average shape were prepared by separating the diamond into bins having progressively more irregular shapes, measuring the mass in each bin, and calculating how much of the most irregular diamond should not be included in a final recombined lot of diamond having a specified average shape. Four lots of diamond were purchased, processed and tested for shape as described above, and tested to determine the optimum shape for a selected abrasive tool, a diamond CMP pad conditioner. The average Roundness Index of the processed lots were 1.113, 1.115, 1.118, and 1.122. Pad conditioners were made via known methods (such as shown, e.g., in U.S. Pat. No. 6,123,612, Goers et al.) and tested for cut rate using fixed conditions to abrade a workpiece. The amount of the workpiece removed was measured in this performance test. The amount of material removed was reported in arbitrary units. Over 4,700 pad conditioner tools were made using these shape-controlled abrasive particles and tested. Each lot of abrasive particles led to a different average cut rate. The tools having an average Roundness Index of 1.115 produced the desired average cut rate in this example. Also in this example, allowing the average Roundness Index to vary by more than about 0.003 or 0.27% resulted in an unacceptable yield of abrasive articles as shown by cut rates outside a desired range.

It is apparent to those skilled in the art from the above description that various modifications can be made without departing from the scope and principles of this invention, and it should be understood that this invention is not to be unduly limited to the illustrative embodiments set forth hereinabove. All publications and patents are herein incorporated by reference to the same extent as if each individual publication or patent was specifically and individually indicated to be incorporated by reference.

What is claimed is:

1. An abrasive tool comprising a substrate, attached to said substrate a selected population of sorted abrasive particles, wherein the selected population is selected from at least two subpopulations of size-sorted and shape-sorted abrasive particles obtained by sorting a plurality of abrasive particles based on size and shape from a general population of abrasive particles having a nonuniform size and shape, wherein each of the at least two subpopulations of shape-sorted abrasive particles is characterized by an average shape, and further wherein the selected population is selected to have a mean Shape Parameter that is controlled to within about 1% of a target value, resulting in a population of abrasive particles having a uniform size and shape.

2. The abrasive tool of claim 1 wherein the average shape is controlled to within about 0.5% of a target value.

3. The abrasive tool of claim 1 wherein the average shape is controlled to within about 0.3% of a target value.

4. The abrasive tool of claim 1 wherein the average shape is controlled to within about 0.2% of a target value.

5. The abrasive tool of claim 1 wherein the particles are provided in a predetermined pattern comprising an orderly array.

6. The abrasive tool of claim 1 wherein the average shape is determined by at least one of Roundness Index, aspect ratio, and sphericity.

7. The abrasive tool of claim 1 wherein the particles are attached to a substrate, wherein the attachment is optionally selected from brazed, infiltrated, electroplated, sintered, liquid-phase sintered, chemically bonded, metallurgically bonded, and adhesively bonded.

8. The abrasive tool of claim 1 wherein the tool is selected from an abrasive cutting tool, saw blade, wire saw, CMP pad conditioner, dressing wheel, cutoff saw, polishing tool, and grinder.

9. A method of making an abrasive tool comprising:

i. providing a multiplicity of non-uniformly sized and shaped abrasive particles;

ii. sorting the multiplicity of non-uniformly sized and shaped abrasive particles into a multiplicity of bins containing sorted abrasive particles, wherein the sorted abrasive particles within each bin have a mass and an average size and shape value;

iii. selecting from the multiplicity of bins a quantity of sorted abrasive particles to obtain a selected uniform population of sorted abrasive particles having an average size and a shape controlled to within about 1 % of a target value;

iv. providing a substrate; and v. attaching the selected uniform population of sorted abrasive particles to the substrate.

10. The method of claim 9 further comprising ordering the particles into a non-random array before attaching the particles to the substrate.

11. The method of claim 9 wherein the average shape is controlled to within a range of a target value selected from about 0.5%, about 0.3%, and about 0.2%.

12. The method of claim 9 wherein attaching the particles to the substrate comprises a process selected from brazing, infiltrating, electroplating, sintering, liquid-phase sintering, chemically bonding, metallurgically bonding, and adhesively bonding.

13. A method of controlling abrasive particle size and shape in an abrasive article comprising:

i. providing a first quantity of size-sorted and shape-sorted abrasive particles obtained by sorting a first general population of abrasive particles based on size and shape from a first general population of abrasive particles having a non-uniform size and shape, and measuring a first Shape Parameter for the first quantity of size-sorted and shape-sorted abrasive particles;

ii. providing a second quantity of size-sorted and shape-sorted abrasive particles obtained by sorting a second general population of abrasive particles based on size and shape from a second general population of abrasive particles having a non-uniform size and shape, and measuring a second Shape Parameter for the second quantity of size-sorted and shape-sorted abrasive particles;

iii. determining a target Shape Parameter between the first Shape Parameter and the second Shape Parameter;

iv. selecting from the first quantity and the second quantity of size-sorted and shape-sorted abrasive particles a selected amount of abrasive particles of the first Shape Parameter with a selected amount of abrasive particles of the second Shape Parameter;

v. combining each selected amount of abrasive particles such that the weighted average combination yields the target Shape Parameter; and vi. forming an abrasive article containing the selected amounts of abrasive particles.

14. The method of claim 13 further comprising providing a third quantity of size-sorted and shape-sorted abrasive particles obtained by sorting a plurality of abrasive particles based on size and shape from a third general population of abrasive particles having a non-uniform size and shape; measuring a third Shape Parameter for the third quantity of size-sorted and shape-sorted abrasive particles; selecting from the third quantity of size-sorted and shape-sorted abrasive particles a selected amount of abrasive particles; and combining the selected amount of abrasive particles at the third Shape Parameter with the other selected amounts of particles such that the weighted average combination yields the target Shape Parameter.

15. The method of claim 14 further comprising providing a fourth quantity of size-sorted and shape-sorted abrasive particles obtained by sorting a plurality of abrasive particles based on size and shape from a fourth general population of abrasive particles having a non-uniform size and shape; measuring a fourth Shape Parameter for the fourth quanity of size-sorted and shape-sorted abrasive particles; selecting from the fourth quantity of size-sorted and shape-sorted abrasive particles a selected amount of abrasive particles; and combining the selected amount of abrasive particles at the fourth Shape Parameter with the other selected amounts of particles such that the weighted average combination yields the target Shape Parameter.

16. The method of claim 15 wherein the target Shape Parameter is selected from at least one of Roundness Index, aspect ratio, and sphericity.

17. A method of producing a plurality of abrasive tools, each of which comprises a plurality of abrasive particles attached to a substrate, wherein each plurality of particles has a mean Shape Parameter within about 1% of a target value, comprising:

i. providing abrasive particles having a non-uniform size and shape;

ii. sorting the abrasive particles by size and shape into a plurality of subpopulations;

iii. selecting an amount of abrasive particles from at least two subpopulations and combining these amounts into a plurality of abrasive particles of uniform size and shape, such that the resulting plurality of abrasive particles has the desired Shape Parameter;

iv. fabricating the abrasive tools from the plurality of abrasive particles having the desired Shape Parameter.

18. The method of claim 17 wherein the Shape Parameter is selected from at least one of Roundness Index, aspect ratio, and sphericity.

19. The method of claim 17 wherein amounts from three to sixteen subpopulations are combined such that the resulting plurality of abrasive particles has the desired Shape Parameter.

* * * * *